US005908013A

United States Patent [19]

Dyess

[11] Patent Number: 5,908,013

[45] Date of Patent: Jun. 1, 1999

[54] TWO-CYCLE ENGINE

[76] Inventor: William C. Dyess, 911 W. Bonneville, P.O. Box 932, Pinedale, Wyo. 82941

[21] Appl. No.: 09/156,121

[22] Filed: Sep. 17, 1998

[51] Int. Cl.[6] ..... F02B 75/02

[52] U.S. Cl. ..... 123/65 BA; 123/65 A; 123/65 W

[58] Field of Search ..... 123/65 R, 65 BA, 123/65 A, 65 W

[56] References Cited

U.S. PATENT DOCUMENTS 1,329,811 2/1920 Smith ..... 50/605.1
5,307,792 5/1994 Takahasm et al. ..... 123/65 A

FOREIGN PATENT DOCUMENTS 358456 9/1931 United Kingdom ..... 123/65

*Primary Examiner*—Henry C. Yuen
*Assistant Examiner*—Hai Huynh

[57] ABSTRACT

A two-cycle engine for boosting intake pressure for higher performance per displacement. The two-cycle engine includes a crankcase having a blower housing and a crankshaft therein extending through the blower housing. The blower housing has an intake opening and a discharge opening. An impeller is disposed around the crankshaft. At least one cylinder is provided with a corresponding piston therein. The cylinder has an exhaust port located on a side wall of the cylinder. An intake conduit extends along the side wall of the cylinder in a spiral rising towards the top of the cylinder and passing beneath the exhaust port to terminate at a pair of intake ports in the side wall of the cylinder. A boost plenum has an intake tube fluidly connecting the discharge opening of the blower housing to the boost plenum. The boost plenum also has a discharge tube fluidly connecting the boost plenum to the intake conduit.

10 Claims, 3 Drawing Sheets

TWO-CYCLE ENGINE

BACKGROUND OF THE INVENTION

1. Field of the Invention

The present invention relates to two-cycle engines and more particularly pertains to a new two-cycle engine for boosting intake pressure for higher performance per displacement.

2. Description of the Prior Art

The use of two-cycle engines is known in the prior art. More specifically, two-cycle engines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,159,903 to Takahashi; U.S. Pat. No. 4,712,520 to Pasquin; U.S. Pat. No. 4,408,579 to Kusche; U.S. Pat. No. 4,964,380 to Kusche; U.S. Pat. No. 4,345,551 to Bloemers; and U.S. Pat. No. Des. 250,026 to Herenius.

While these devices fulfill their respective, particular objectives and requirements, the aforementioned patents do not disclose a new two-cycle engine. The inventive device includes a crankcase having a blower housing and a crankshaft therein extending through the blower housing. The blower housing has an intake opening and a discharge opening. An impeller is disposed around the crankshaft. At least one cylinder is provided with a corresponding piston therein. The cylinder has an exhaust port located on a side wall of the cylinder. An intake conduit extends along the side wall of the cylinder in a spiral rising towards the top of the cylinder and passing beneath the exhaust port to terminate at a pair of intake ports in the side wall of the cylinder. A boost plenum has an intake tube fluidly connecting the discharge opening of the blower housing to the boost plenum. The boost plenum also has a discharge tube fluidly connecting the boost plenum to the intake conduit.

In these respects, the two-cycle engine according to the present invention substantially departs from the conventional concepts and designs of the prior art, and in so doing provides an apparatus primarily developed for the purpose of boosting intake pressure for higher performance per displacement.

SUMMARY OF THE INVENTION

In view of the foregoing disadvantages inherent in the known types of two-cycle engines now present in the prior art, the present invention provides a new two-cycle engine construction wherein the same can be utilized for boosting intake pressure for higher performance per displacement.

The general purpose of the present invention, which will be described subsequently in greater detail, is to provide a new two-cycle engine apparatus and method which has many of the advantages of the two-cycle engines mentioned heretofore and many novel features that result in a new two-cycle engine which is not anticipated, rendered obvious, suggested, or even implied by any of the prior art two-cycle engines, either alone or in any combination thereof.

To attain this, the present invention generally comprises a crankcase having a blower housing and a crankshaft therein extending through the blower housing. The blower housing has an intake opening and a discharge opening. An impeller is disposed around the crankshaft. At least one cylinder is provided with a corresponding piston therein. The cylinder has an exhaust port located on a side wall of the cylinder. An intake conduit extends along the side wall of the cylinder in a spiral rising towards the top of the cylinder and passing beneath the exhaust port to terminate at a pair of intake ports in the side wall of the cylinder. A boost plenum has an intake tube fluidly connecting the discharge opening of the blower housing to the boost plenum. The boost plenum also has a discharge tube fluidly connecting the boost plenum to the intake conduit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new two-cycle engine apparatus and method which has many of the advantages of the two-cycle engines mentioned heretofore and many novel features that result in a new two-cycle engine which is not anticipated, rendered obvious, suggested, or even implied by any of the prior art two-cycle engines, either alone or in any combination thereof.

It is another object of the present invention to provide a new two-cycle engine which may be easily and efficiently manufactured and marketed.

It is a further object of the present invention to provide a new two-cycle engine which is of a durable and reliable construction.

An even further object of the present invention is to provide a new two-cycle engine which is susceptible of a low cost of manufacture with regard to both materials and labor, and which accordingly is then susceptible of low prices of sale to the consuming public, thereby making such two-cycle engine economically available to the buying public.

Still yet another object of the present invention is to provide a new two-cycle engine which provides in the apparatuses and methods of the prior art some of the advantages thereof, while simultaneously overcoming some of the disadvantages normally associated therewith.

Still another object of the present invention is to provide a new two-cycle engine for boosting intake pressure for higher performance per displacement.

Yet another object of the present invention is to provide a new two-cycle engine which includes a crankcase having a blower housing and a crankshaft therein extending through the blower housing. The blower housing has an intake opening and a discharge opening. An impeller is disposed around the crankshaft. At least one cylinder is provided with a corresponding piston therein. The cylinder has an exhaust port located on a side wall of the cylinder. An intake conduit extends along the side wall of the cylinder in a spiral rising towards the top of the cylinder and passing beneath the exhaust port to terminate at a pair of intake ports in the side wall of the cylinder. A boost plenum has an intake tube fluidly connecting the discharge opening of the blower housing to the boost plenum. The boost plenum also has a discharge tube fluidly connecting the boost plenum to the intake conduit.

Still yet another object of the present invention is to provide a new two-cycle engine that does not introduce lubricating oil into the combustion chamber, thereby reducing the high emissions typical of two-cycle engine.

Even still another object of the present invention is to provide a new two-cycle engine that may be used to provide more horse power and lower emissions to two-cycle engines of recreational vehicles including snowmobiles, personal watercraft and outboard boat motors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
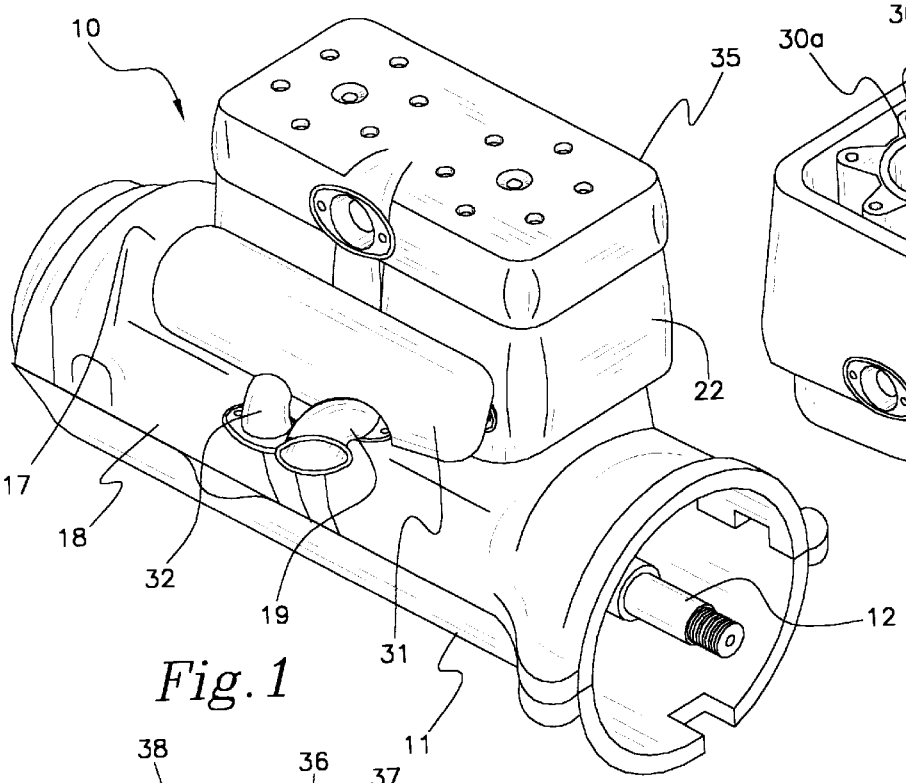
FIG. 1 is a schematic perspective view of a new two-cycle engine according to the present invention.

With reference now to the drawings, and in particular to FIGS. 1 through 10 thereof, a new two-cycle engine embodying the principles and concepts of the present invention and generally designated by the reference numeral 10 will be described.

As best illustrated in FIGS. 1 through 10, the two-cycle engine 10 generally comprises a crankcase 11 having a blower housing 13 and a crankshaft 12 therein extending through the blower housing 13. The blower housing 13 has an intake opening 15 and a discharge opening 16. An impeller 21 is disposed around the crankshaft 12. At least one cylinder 23 is provided with a corresponding piston 24 therein. The cylinder 23 has an exhaust port 28 located on a side wall 27 of the cylinder 23. An intake conduit 29 extends along the side wall 27 of the cylinder 23 in a spiral rising towards the top 25 of the cylinder 23 and passing beneath the exhaust port 28 to terminate at a pair of intake ports 30*a*,30*b* in the side wall 27 of the cylinder 23. A boost plenum 31 has an intake tube 32 fluidly connecting the discharge opening 16 of the blower housing 13 to the boost plenum 31. The boost plenum 31 also has a discharge tube 33 fluidly connecting the boost plenum 31 to the intake conduit 29.

In closer detail, with reference to FIGS. 7, 8, 9, and 10, the crankcase 11 has a blower housing 13 and a crankshaft 12 therein extending through the blower housing 13. The blower housing is sealed off from the rest of the crankcase 11 by a pair of blower seals 14*a*, 14*b*. Ideally, the blower seals are billow-type seals that billow outwards from the blower housing to seal the housing as the pressure in the blower housing increases. The blower housing 13 has an intake opening 15 and a discharge opening 16. The crank driven impeller 21 is disposed mounted on the crankshaft 12 such that rotating of the crankshaft 12 rotates the impeller 21. The impeller 21 is located in blower housing 13. In use, the impeller 21 forcing the air and fuel mixture through the blower housing 13 from the intake opening 15 of the blower housing 13 and out through the discharge opening 16 of the blower housing 13.

Preferably, the intake opening 15 of the blower housing 13 is positioned in an upper region 17 of the blower housing 13 and the discharge opening 16 of the blower housing 13 is positioned in a side region 18 of the blower housing 13. This positioning of the intake and discharge openings 15,16 of the blower housing 13 causes the intake path of the engine to be isolated from the rest of the interior of the crank case. The blower housing is preferably of a convoluted shape similar to the ram's horn design of traditional belt driven centrifugal supercharges using a discharge volute. The intake opening 15 of the blower housing 13 has a carburetor/throttle body boot 19 designed for fluidly connecting the intake opening 15 of the blower housing 13 to a carburetor/throttle body. The carburetor/throttle body boot 19 preferably comprises a rubber boot with a metal or hard plastic base 20 for mounting to the crankcase 11 over the intake opening 15.

Figure 2:
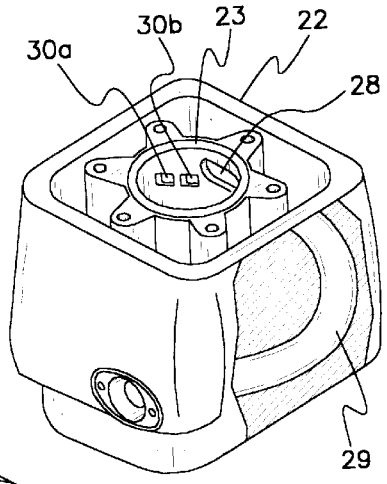
FIG. 2 is a schematic break away view of a cylinder region of the present invention illustrating the intake conduit.
Figure 3:
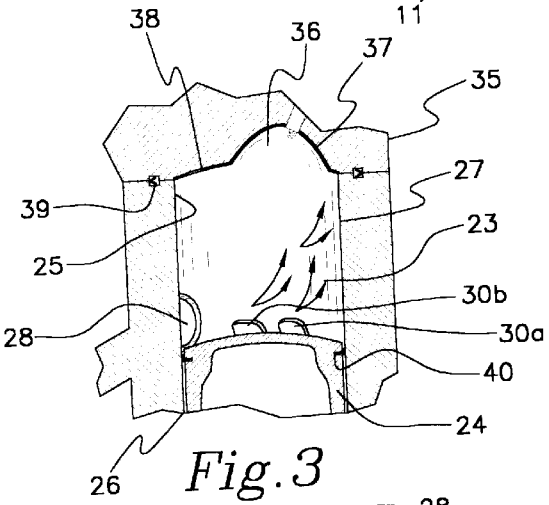
FIG. 3 is a schematic cross sectional view of the cylinder region of the present invention.
Figure 4:
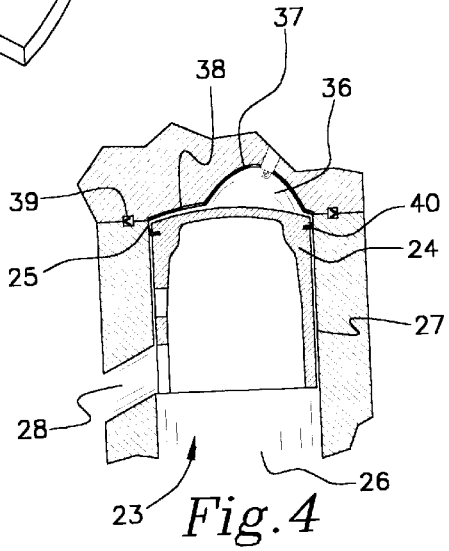
FIG. 4 is a schematic side cross sectional view of the cylinder region of the present invention at the end of the compression stroke.
Figure 5:
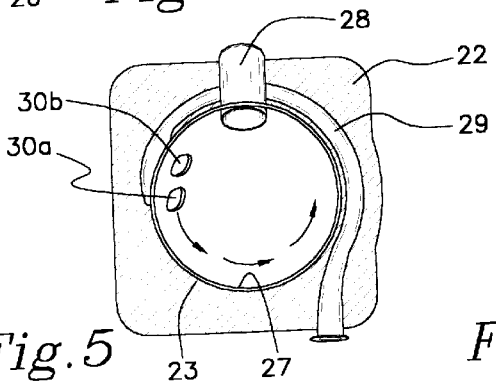
FIG. 5 is a schematic top cross sectional view of the cylinder region of the present invention.

With reference to FIGS. 2, 3, 4, 5, and 7, the engine block 22 has at least one cylinder 23 with a corresponding piston 24 therein which is connected to the crankshaft 12 to rotate the crankshaft 12. The cylinder 23 has a top 25, a bottom 26, and a generally cylindrical side wall 27 extending between the top 25 and bottom 26 of the cylinder 23. The cylinder 23 has an exhaust port 28 located on the side wall 27 of the cylinder 23 between the top 25 and bottom 26 of the cylinder 23. The engine block 22 also has an intake conduit 29 for the cylinder 23. As illustrated in FIGS. 2 and 5, the intake conduit 29 extends around the side wall 27 of the cylinder 23 between about one-quarter and about three-quarters of the circumference of the cylinder 23 in a spiral rising in a direction from the bottom 26 of the cylinder 23 towards the top 25 of the cylinder 23 and passes beneath the exhaust port 28 to terminate at a pair of intake ports 30*a*,30*b* in the side wall 27 of the cylinder 23. Ideally, the intake conduit 29 extends around the side wall 27 of the cylinder 23 about one-half of the circumference of the cylinder 23. This configuration lets the intake boost avoid the exhaust port when entering the cylinder. By running the intake conduit beneath the exhaust port, heat can be transferred from the exhaust skirt of the piston, which will not otherwise have the cooling effect of the cold intake contained in the crankcase of a conventional two-cycle engine.

The intake ports 30*a*, 30*b* are preferably positioned on the side wall 27 of the cylinder 23 towards the exhaust port 28. The intake ports 30*a*,30*b* and the exhaust port 28 of the side wall 27 of the cylinder 23 ideally generally lie in a common horizontal plane with the intake ports 30*a*,30*b* in the side wall 27 of the cylinder 23 configured to direct fluid from the intake conduit 29 into the cylinder 23 in a direction along the side wall 27 of the cylinder 23 upwards and away from the exhaust port 28 as illustrated in FIGS. 3 and 5. The intake ports are preferably angled to propel the boosted intake high into the cylinder along the side wall of the cylinder distal the exhaust port to swirl the boosted intake around the cylinder and into the combustion chamber while avoiding the exhaust port.

Figure 7:
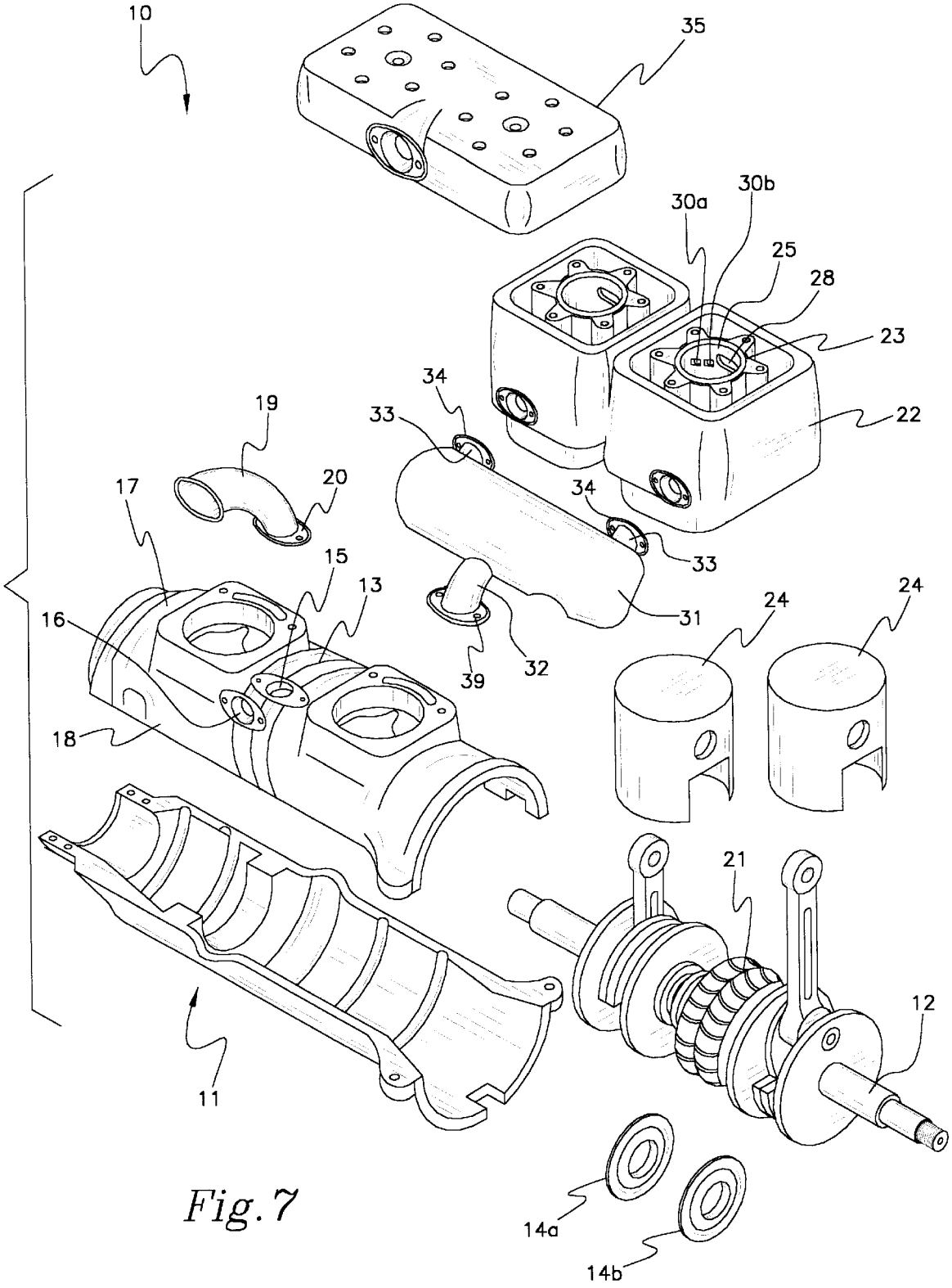
FIG. 7 is a schematic exploded perspective view of the present invention.
Figure 8:
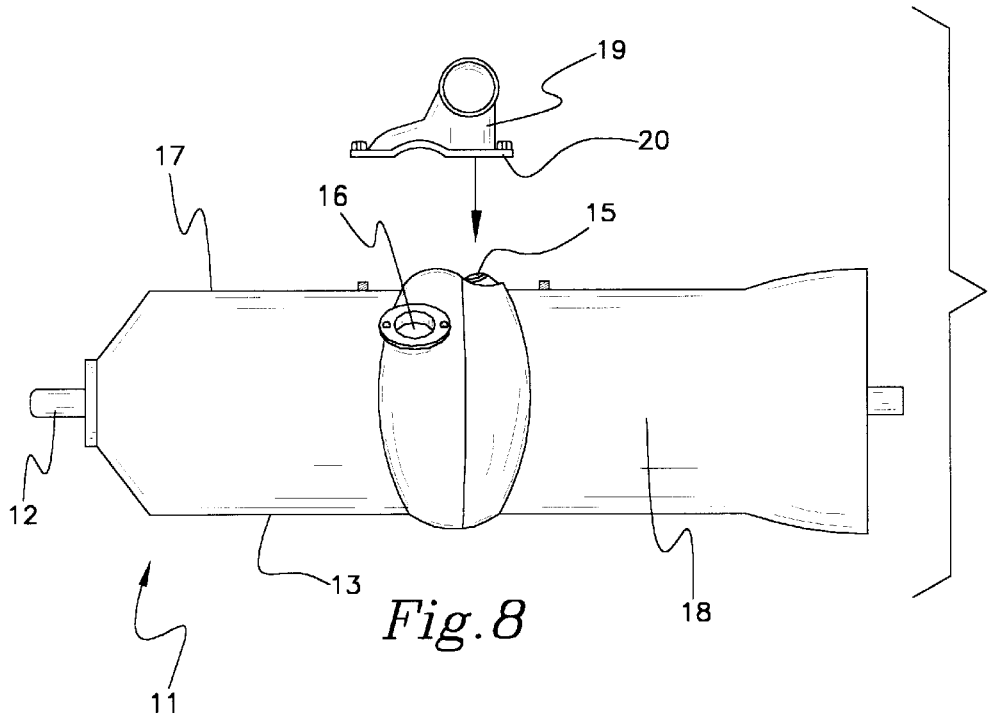
FIG. 8 is a schematic side view of the crankcase of the present invention.
Figure 9:
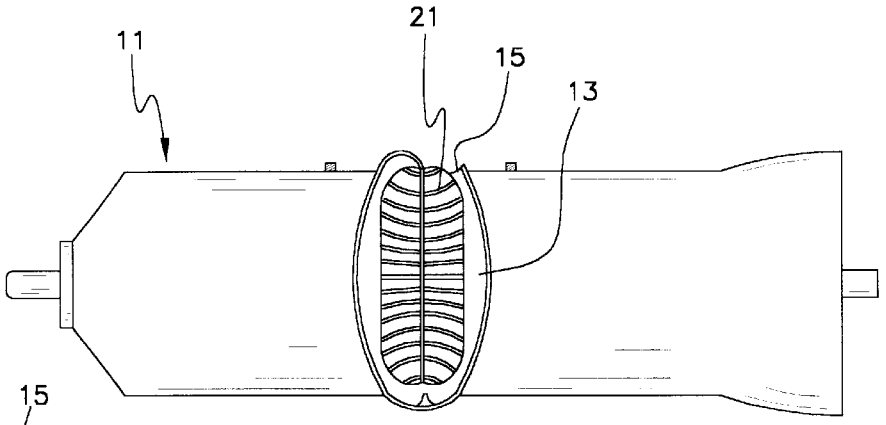
FIG. 9 is a schematic breakaway view of the blower housing of the present invention.
Figure 10:
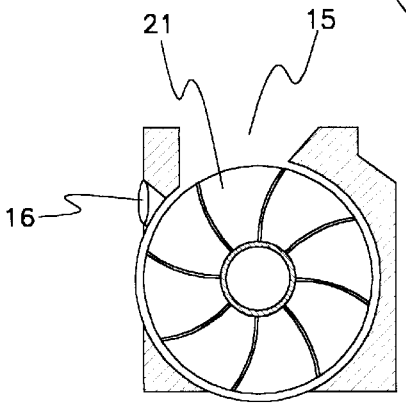
FIG. 10 is a schematic cross sectional view of the blower housing of the present invention.

With reference to FIG. 7, the boost plenum 31 has an intake tube 32 fluidly connecting the discharge opening 16 of the blower housing 13 to the boost plenum 31 to permit passage of the boosted intake from the discharge opening 16 of the blower housing 13 into the boost plenum 31. The boost plenum 31 has a discharge tube 33 for each cylinder 23. The discharge tube 33 of the boost plenum 31 fluidly connects the boost plenum 31 to the intake conduit 29 to permit passage of boosted intake from the boost plenum 31 into the intake conduit 29. The boost plenum is basically an intake manifold that may function as a means of dissipating some of the heat put into the compression of the fuel/air mixture, or as an air to air inter-cooler, or as a reservoir to store compressed fuel/air mixture. The intake and discharge tubes 32,33 of the boost plenum 31 each preferably have a rubber isolation mount 34 for connecting the intake tube 32 to the crankcase 11 and the discharge tube 33 to the engine block 22. The isolation mounts are important for vibration and heat isolation and also for isolating the boost plenum for its resonant or sonic activity which may be used to enhance the fuel/air charge to the cylinder coincidentally with the return wave of the exhaust to promote cylinder scavenging with less likelihood of short circuiting the exhaust port.

Figure 6:
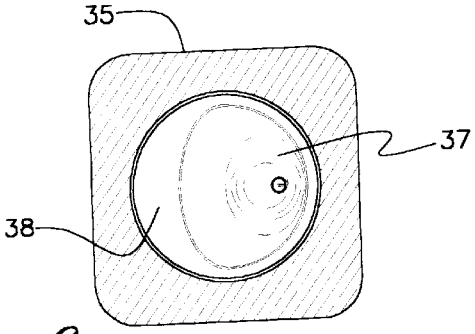
FIG. 6 is a schematic bottom cross sectional view of the cylinder region of the present invention looking up into the combustion chamber.

With reference to FIGS. 3, 4, and 6, a cylinder head 35 is mounted to the engine block 22 and covers the top 25 of all of the cylinders 23. The cylinder head 35 has a combustion chamber 36 for each cylinder over the top 25 of the respective cylinder 23. The combustion chamber 36 has an offset combustion dome 37 and an elliptical squish band 38. The squish band 38 is positioned towards a first side region of the side wall 27 of the cylinder 23 has the exhaust port 28 located therein. The combustion dome 37 is located towards an opposite second side region of the side wall 27 of the cylinder 23 located distal the first side region such that the combustion dome 37 is positioned away from the exhaust port 28. The combustion dome 37 and the squish band 38 each have a generally arcuate vertical cross section. As illustrated in FIGS. 3 and 4, the vertical cross sections of the combustion dome 37 and the squish band 38 each has a radius of curvature, the radius of curvature of the vertical cross section of the squish band 38 is greater than the radius of curvature of the vertical cross section of the combustion dome 37 so that the vertical cross section of the squish band 38 is flatter than the vertical cross section of the combustion dome 37. This design permits higher compression ratios by lowering the chance of detonation on the exhaust side to the piston by concentrating the squish band on the exhaust port side to protect the highly heated portion of the piston. The offsetting of combustion dome, the resulting angle of burn after ignition will lap up the remaining boundary layer of unburned fuel from the squish area when the piston starts its descent towards the exhaust port to reduce the amount of hydrocarbon emissions.

Preferably, an annular head gasket 39 is provided between the cylinder head 35 and the engine block 22 to provide a seal between the top 25 of the cylinder 23 and the combustion chamber 36. The head gasket 39 ideally has a generally V-shaped transverse cross section. The piston 24 preferably has an annular piston ring 40 therearound and interposed between the piston 24 and the side wall 27 of the cylinder 23 for providing a seal between the side wall 27 of the cylinder 23 and the piston 24. Ideally, the piston ring 40 has a generally L-shaped transverse cross section. These transverse cross sections are designed to work well under high cylinder pressures.

The two-cycle engine is preferably a liquid cooled engine with any number of cylinders. This two-cycle engine does not require the crankcase for induction and therefore does not require oil to be mixed in the fuel mixture and thereby consumed in the combustion process. This allows an oil recovery system to be used in crankcase.

In use, the fuel/air mixture is drawn into the blower housing through the intake opening and charged or boosted intake exits via the discharge opening into the booster plenum. From the booster plenum the boosted intake is passed through the intake conduit and into the cylinder through the intake ports.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A two-cycle engine, comprising:

a crankcase having a blower housing and a crankshaft therein extending through said blower housing;

said blower housing having an intake opening and a discharge opening;

an impeller being disposed around said crankshaft such that rotating of said crankshaft rotates said impeller, said impeller being located in blower housing;

at least one cylinder having a corresponding piston therein;

said cylinder having a top, a bottom, and a generally cylindrical side wall, said side wall of said cylinder having a circumference;

said cylinder having an exhaust port located on said side wall of said cylinder;

an intake conduit extending along said side wall of said cylinder in a spiral rising towards said top of said cylinder and passing beneath said exhaust port to terminate at a pair of intake ports in said side wall of said cylinder;

a boost plenum having an intake tube fluidly connecting said discharge opening of said blower housing to said boost plenum to permit passage of fluid from said discharge opening of said blower housing into said boost plenum; and said boost plenum having a discharge tube fluidly connecting said boost plenum to said intake conduit to permit passage of fluid from said boost plenum into said intake conduit.

2. The two-cycle engine of claim 1, wherein said intake opening of said blower housing is positioned in a upper region of said blower housing and said discharge opening of said blower housing is positioned in a side region of said blower housing.

3. The two-cycle engine of claim 1, wherein said intake opening of said blower housing has a carburetor/throttle body boot adapted for fluidly connecting said intake opening of said blower housing to a carburetor.

4. The two-cycle engine of claim 1, wherein said intake conduit extends around said side wall of said cylinder between about one-quarter and about three-quarters of said circumference of said cylinder.

5. The two-cycle engine of claim 4, wherein said intake conduit extends around said side wall of said cylinder about one-half of said circumference of said cylinder.

6. The two-cycle engine of claim 1, wherein said intake ports are positioned on said side wall of said cylinder towards said exhaust port.

7. The two-cycle engine of claim 6, wherein said intake ports and said exhaust ports of said side wall of said cylinder generally lie in a common horizontal plane, said intake ports in said side wall of said cylinder being configured to direct fluid from said intake conduit into said cylinder in a direction along said side wall of said cylinder upwards and away from said exhaust port.

8. The two-cycle engine of claim 1, wherein said squish band is positioned towards a first side region of said side wall of said cylinder having said exhaust port located therein and said combustion dome is located towards an opposite second side region of said side wall of said cylinder located distal said first side region.

9. The two-cycle engine of claim 1, wherein said combustion dome and said squish band each have a generally arcuate vertical cross section, said vertical cross sections of said combustion dome and said squish band each having a radius of curvature, said radius of curvature of said vertical cross section of said squish band being greater than said radius of curvature of said vertical cross section of said combustion dome.

10. A two-cycle engine, comprising:

a crankcase having crankshaft therein and a blower housing, said crankshaft extending through said blower housing;

said blower housing having an intake opening and a discharge opening, said intake opening of said blower housing being positioned in a upper region of said blower housing, said discharge opening of said blower housing being positioned in a side region of said blower housing;

said intake opening of said blower housing having a carburetor/throttle body boot adapted for fluidly connecting said intake opening of said blower housing to a carburetor;

an impeller being disposed around said crankshaft such that rotating of said crankshaft rotates said impeller, said impeller being located in blower housing;

an engine block having at least one cylinder having a corresponding piston therein;

said cylinder having a top, a bottom, and a generally cylindrical side wall, said side wall of said cylinder having a circumference;

said cylinder having an exhaust port located on said side wall of said cylinder between said top and bottom of said cylinder;

said engine block having an intake conduit for said cylinder, said intake conduit extending around said side wall of said cylinder between about one-quarter and about three-quarters of said circumference of said cylinder in a spiral rising towards said top of said cylinder and passing beneath said exhaust port to terminate at a pair of intake ports in said side wall of said cylinder;

wherein said intake conduit extends around said side wall of said cylinder about one-half of said circumference of said cylinder;

said intake ports being positioned on said side wall of said cylinder towards said exhaust port;

said intake ports and said exhaust ports of said side wall of said cylinder generally lying in a common horizontal plane, said intake ports in said side wall of said cylinder being configured to direct fluid from said intake conduit into said cylinder in a direction along said side wall of said cylinder upwards and away from said exhaust port;

a boost plenum having an intake tube fluidly connecting said discharge opening of said blower housing to said boost plenum to permit passage of fluid from said discharge opening of said blower housing into said boost plenum;

said boost plenum having a discharge tube for each cylinder, said discharge tube of said boost plenum fluidly connecting said boost plenum to said intake conduit to permit passage of fluid from said boost plenum into said intake conduit;

a cylinder head covering said top of said cylinder, said cylinder head having a combustion chamber over said top of said cylinder;

said combustion chamber having a combustion dome and an elliptical squish band, said squish band being positioned towards a first side region of said side wall of said cylinder having said exhaust port located therein, said combustion dome being located towards an opposite second side region of said side wall of said cylinder located distal said first side region;

said combustion dome and said squish band each having a generally arcuate vertical cross section, said vertical cross sections of said combustion dome and said squish band each having a radius of curvature, said radius of curvature of said vertical cross section of said squish band being greater than said radius of curvature of said vertical cross section of said combustion dome;

an annular head gasket between said cylinder head and said engine block to provide a seal between said top of said cylinder and said combustion chamber, said head gasket having a generally V-shaped transverse cross section; and said piston having an annular piston ring therearound and interposed between said piston and said side wall of said cylinder for providing a seal between said side wall of said cylinder and said piston, said piston ring having a generally L-shaped transverse cross section.

* * * * *